US008175310B2

(12) United States Patent
Nielsen et al.

(10) Patent No.: US 8,175,310 B2
(45) Date of Patent: May 8, 2012

(54) BTE HEARING AID ADAPTOR

(75) Inventors: Henrik Nielsen, Roskilde (DK); Nikolai Bisgaard, Kgs. Lyngby (DK)

(73) Assignee: GN Resound A/S, Ballerup (DK)

( * ) Notice: Subject to any disclaimer, the term of this patent is extended or adjusted under 35 U.S.C. 154(b) by 1158 days.

(21) Appl. No.: 11/576,431

(22) PCT Filed: Sep. 30, 2005

(86) PCT No.: PCT/DK2005/000627

§ 371 (c)(1),
(2), (4) Date: May 10, 2007

(87) PCT Pub. No.: WO2006/037326

PCT Pub. Date: Apr. 13, 2006

(65) Prior Publication Data

US 2008/0253598 A1 Oct. 16, 2008

Related U.S. Application Data

(60) Provisional application No. 60/616,312, filed on Oct. 5, 2004.

(30) Foreign Application Priority Data

Oct. 1, 2004 (DK) ..... 2004 01501

(51) Int. Cl.
*H04R 25/00* (2006.01)

(52) U.S. Cl. ..... 381/330; 381/322; 381/328

(58) Field of Classification Search ..... 381/322, 381/324, 325, 327, 328, 330, 381, 382; 181/129, 181/130, 135
See application file for complete search history.

(56) References Cited

U.S. PATENT DOCUMENTS 3,124,663 A 3/1964 Beaudry (Continued)

FOREIGN PATENT DOCUMENTS

EP 0158391 A1 10/1985

(Continued)

OTHER PUBLICATIONS

International Search Report for Application No. PCT/DK2005/000627.

(Continued)

*Primary Examiner* — Huyen D Le
(74) *Attorney, Agent, or Firm* — Vista IP Law Group, LLP

(57) ABSTRACT

The present invention relates to an adaptor for a BTE hearing aid with a housing to be worn behind the ear, an earpiece for insertion in the earcanal, and a signal transmission member for transmission of a signal from the housing at a first end of the member to the earpiece at a second end of the member, the signal transmission member having a connector at the first end, wherein the housing and the connector of the signal transmission member are not adapted for mutual mechanical interconnection, wherein the adaptor has a first end that is geometrically adapted for mechanical connection with the connector of the signal transmission member and a second end that is geometrically adapted for mechanical connection with the housing, so that the signal transmission member and the housing can be mechanically interconnected through the adaptor whereby the variety of signal transmission member units to be kept in stock by a hearing aid dispenser is substantially minimized.

24 Claims, 6 Drawing Sheets

U.S. PATENT DOCUMENTS

| | | | | |
|---|---|---|---|---|
| 3,297,832 | A | 1/1967 | Brown | |
| 3,930,560 | A | 1/1976 | Carlson et al. | |
| 4,381,830 | A | 5/1983 | Jelonek et al. | |
| 4,977,976 | A | 12/1990 | Major | |
| 5,753,870 | A | 5/1998 | Schlaegel et al. | |
| 7,027,608 | B2 * | 4/2006 | Fretz et al. | 381/330 |
| 7,139,404 | B2 * | 11/2006 | Feeley et al. | 381/330 |
| 2004/0010181 | A1 * | 1/2004 | Feeley et al. | 600/25 |

FOREIGN PATENT DOCUMENTS

| | | | |
|---|---|---|---|
| EP | 0540862 | A2 | 5/1993 |
| EP | 1448014 | A1 | 8/2004 |
| JP | 08-330038 | | 12/1996 |
| JP | 2001510976 | | 8/2001 |
| JP | 2002-324637 | | 8/2002 |
| WO | 9700593 | A1 | 1/1997 |
| WO | 9904601 | | 1/1999 |
| WO | 2004025990 | | 3/2004 |
| WO | 2004025990 | A1 | 3/2004 |
| WO | 2004080123 | | 9/2004 |
| WO | 2006 037326 | A2 | 4/2006 |

OTHER PUBLICATIONS

Written Opinion of The International Searching Authority for Application No. PCT/DK2005/000627.

Japanese Office Action for Japanese Application No. 2007-533870, Mailed on Dec. 27, 2011.

* cited by examiner

BTE HEARING AID ADAPTOR

PRIORITY DATA

This application is the national stage of International Application PCT/DK2005/000627, filed on Sep. 30, 2005, which claims priority to Danish Patent Application No. PA 2004 01501, filed on Oct. 1, 2004, and U.S. Provisional Patent Application No. 60/616,312, filed on Oct. 5, 2004, the entire disclosures of all of which are expressly incorporated by reference herein.

FIELD OF THE INVENTION

The present invention relates to simplified manufacturing of a large variety of BTE (Behind-The-Ear) hearing aids whereby the variety of parts to be kept in stock by a hearing aid dispenser is substantially minimized.

BACKGROUND OF THE INVENTION

Behind-the-ear hearings aids in which a sound tube conducts sound generated by the receiver of the hearing aid into the ear canal are well known in the art. In order to position the sound tube securely and comfortably in the ear canal, an earpiece, shell, or earmould is provided for insertion into the ear canal of the user.

Typically, the earpiece, shell, or earmould is individually custom manufactured to fit the user's ear to sufficiently secure the hearing aid tube in place in the ear canal and prevent the earpiece from falling out of the ear and avoid acoustical feed back, e.g., when the user is moving around. The custom made earpiece adds to the cost of the device and the time needed to fit the hearing aid.

In order to lower the manufacturing cost, it is known to manufacture the earpiece, shell, or earmould in a number of standard sizes to fit the human anatomy of the ear of most users.

So-called "open" BTE earpieces are generally preferred in order to affect the ear canal as little as possible by avoiding blockage of the ear canal, i.e. the occlusion effect. This also assists in maintaining the natural hearing capacity and the physical environment of the user.

U.S. Pat. No. 5.753.870 discloses a BTE hearing aid with a connector for connection of a sound tube to an earmould. One end of the connector is adapted for receiving the sound tube and further accommodating a filter for improved sound quality. The bends of the propagation path is provided by the hook of the BTE housing and the connector, respectively. The sound tube is substantially straight in its mounted position.

EP 1 448 014 discloses a BTE hearing aid with an earpiece that is adapted for insertion into an ear canal of a user and has at least one resilient fibre that is connected to the earpiece for abutting a lower part of the concha when the earpiece has been inserted in the ear canal thereby providing retention of the earpiece in the ear canal of the user.

Typically, the sound tube is attached to a connector for coupling of the sound tube to the BTE housing containing the electronics of the hearing aid. The sound tube is typically flexible so that the sound tube is allowed to bend and provide the required arcuate propagation path of the sound from the receiver output at the BTE housing to the earpiece, shell, or earmould. The sound tube is cut in the desired length.

In the BTE hearing aid disclosed in EP 1 448 014, the sound tube has a pre-formed shape that includes a first bend extending from the connector over the top of the ear of the user and a second bend extending from an outside of the ear into an ear canal of the user.

It is also known to manufacture the sound tube with connector and earpiece in one unit in a large variety of standard sizes, for example with different lengths between the first and the second bend, e.g. 4 different lengths, and different lengths between the second bend and the earpiece, e.g. 2 different lengths, to fit the human anatomy of the ear of most users. Further, the sound tubes may be fitted with earpieces of different sizes e.g. 3 different standard sizes, or custom mold. Finally, the sound tube has to be manufactured with bends adapted to the right ear and bends adapted to the left ear. The present example leads to 48 (4*2*3*2) standard sizes of the unit to be manufactured and to be kept in stock by the hearing aid dispensers. Still further, the sound tube may be delivered with various diameters further multiplying the required number of standard sizes.

Further, different manufactures of hearing aids typically apply different coupling principles for coupling of the sound tube connector to the hearing aid housing, such as threading, snap fit coupling, etc, which multiplies the variety of sound tube units to be kept in stock by the hearing aid dispenser.

There is a need for a device that can diminish the number of parts to be kept in stock by hearing aid dispensers.

SUMMARY OF THE INVENTION

According to the present invention, the above and other objects are fulfilled by provision of an adaptor for a BTE hearing aid with a housing to be worn behind the ear, an earpiece for insertion in the earcanal, and a signal transmission member for transmission of a signal from the housing at a first end of the member to the earpiece at a second end of the member, the signal transmission member having a connector at the first end. The hearing aid housing and the connector of the signal transmission member are not adapted for direct mechanical interconnection with each other, however, the first end of the adaptor is geometrically adapted for mechanical connection with the connector of the signal transmission member and the second end is geometrically adapted for mechanical connection with the housing, so that the signal transmission member and the housing can be mechanically interconnected through the adaptor.

It is an important advantage of the present invention that the variety of signal transmission member units to be kept in stock by a hearing aid dispenser is substantially minimized.

The signal transmission member may be a sound tube for propagation of sound signals as acoustic signals from a receiver positioned in the BTE hearing aid housing and through the sound tube the earpiece having an output port for transmission of the sound to the eardrum in the ear canal.

The signal transmission member may alternatively be an electrical conductor for propagation of electrical audio signals from the output of a signal processor in the BTE hearing aid housing through the conductor to a receiver positioned in the earpiece for emission of sound through an output port of the earpiece.

The provision of the adaptor eliminates the need for manufacturing the sound tube units with different types of connectors for connection with BTE housings from different manufacturers. For example, if a sound tube unit is produced in p different sizes and with q different coupling mechanisms, then according to the prior art, p*q different parts must be manufactured and kept in stock for every combination of size and coupling mechanism to be available. The adaptor according to the present invention reduces the required number of parts to p+q (p sizes of the sound tube plus q different adaptors).

Thus, a set of adaptors for a BTE hearing aid is also provided, comprising at least two different adaptors according to the present invention, for example making it possible to interconnect a signal transmission member from one manufacturer with a respective hearing aid housing from at least two different manufacturers, the manufacturers utilizing different mechanical coupling geometries that prevent direct mechanical interconnection of their parts.

Preferably, a signal transmission member, such as a sound tube, to be used with the adaptor is shorter than the corresponding signal transmission member used without the adaptor so that the BTE hearing aid housing remains in substantially the same position behind the ear whether it is used with an adaptor or not. Hereby, the microphone of the hearing aid is allowed to remain in the originally intended position behind the ear when the hearing aid is used with an adaptor.

The connector is a member that may be over-moulded onto the signal transmission member, e.g. the sound tube. Alternatively, the connector may be moulded first and then bonded to the member.

The signal transmission member may further be provided with a member, such as a plug, at the end to be connected with an earpiece for attachment of the signal transmission member to the earpiece, e.g. by bayonet coupling or gluing, etc.

In one embodiment, the signal transmission member, the signal transmission member connector, and the member, such as a plug, may be moulded to form one integrated unit, for example the sound tube, the sound tube connector, and the member, such as a plug, may be moulded to form one integrated unit.

The adaptor may further comprise a compartment communicating with the sound tube and accommodating an acoustical filter or a cerumen guard.

Still further, the adaptor may comprise a compartment accommodating a wind noise filter.

Yet still further, the adaptor may comprise a compartment for accommodating a member with a left/right marking, or a left/right marking may be printed on the adaptor.

In a preferred embodiment of the invention, the sound tube has an inner diameter of ranging from about 0.8 mm to about 2 mm. The tube is preferably formed of a material with a durometer of 65 to 85 Shore D.

BRIEF DESCRIPTION OF THE DRAWINGS

Below, the invention will be further described and illustrated with reference to the accompanying drawings in which.

DETAILED DESCRIPTION OF PREFERRED EMBODIMENTS

Figure 1:
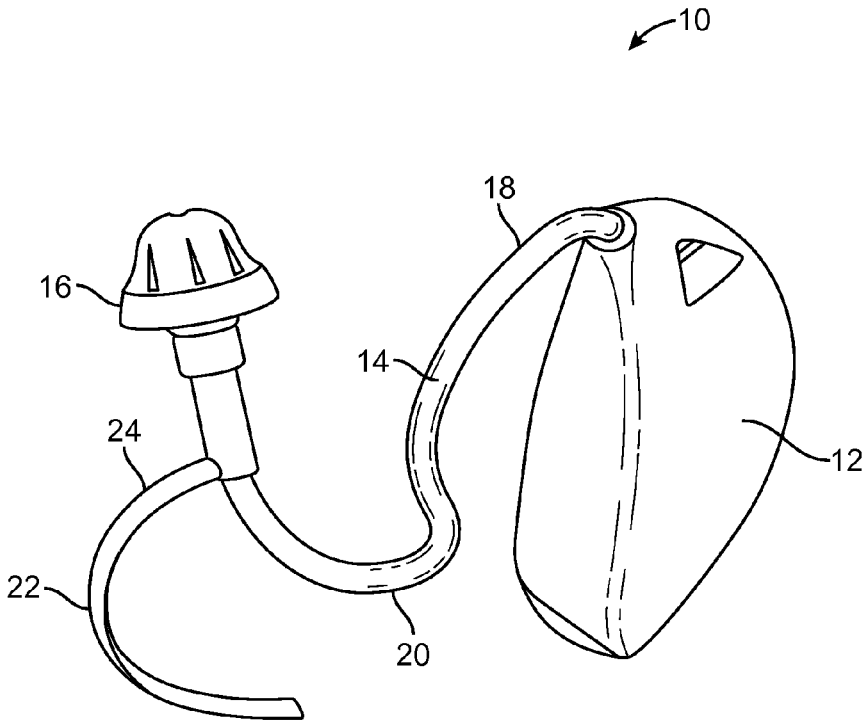
FIG. 1 (PRIOR ART)
FIG. 1 is a perspective view of a prior art BTE hearing aid with an open earpiece.

FIG. 1 shows in perspective a prior art BTE hearing aid 10. The BTE hearing aid 10 comprises a hearing aid housing 12, a signal transmission member 14, in the illustrated exemplary embodiment a sound tube, having a pre-formed shape for conducting sound from the hearing aid housing 12 to the ear canal (not shown), and an earpiece 16 attached to the sound tube 14 for insertion into the ear canal.

The hearing aid housing 12 is configured to be worn behind the ear of a user and contains a battery, a microphone, a processor, and a receiver (not shown) for generating sound that is input into the sound tube 14.

The pre-formed shape of the sound tube 14 includes a first bend 18 extending from the case over the top of the ear of the user and a second bend 20 extending from an outside of the ear into an ear canal of the user when the hearing aid 10 is worn by the user.

The earpiece 16 is configured to fit within the ear canal and, preferably, allows sounds outside and within the ear to pass through the ear canal around the earpiece.

Further, the hearing aid 10 has an arcuate, preferably resilient, fibre 22 with one end 24 that is connected to the earpiece or the sound tube. The fibre 22 is adapted for abutting a surface of the outer ear when the earpiece 16 has been inserted in the ear canal thereby providing retention of the earpiece 16 in the ear canal of the user.

Figure 2:
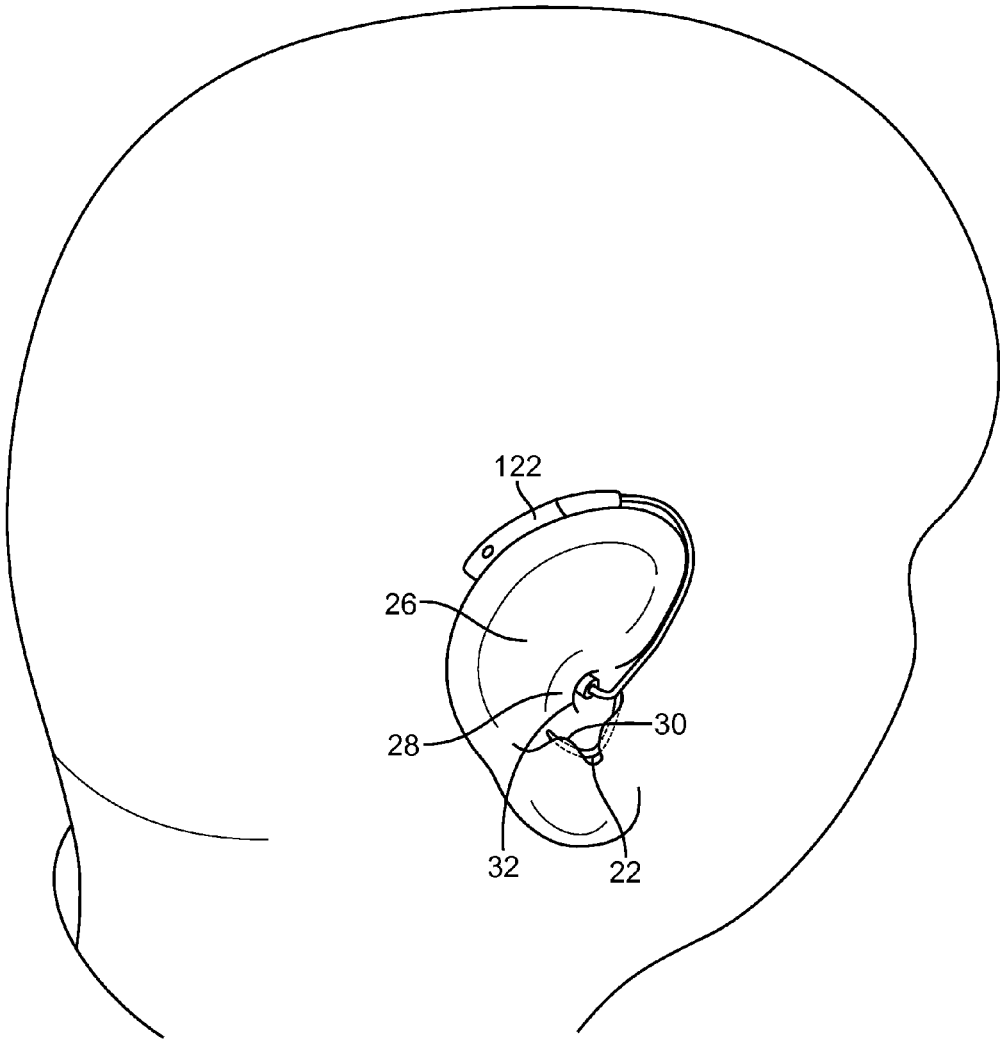
FIG. 2 (PRIOR ART)
FIG. 2 is a photo providing a side view of a prior art BTE hearing aid positioned at a user's right ear.

FIG. 2 is a photo that illustrates correct positioning of the hearing aid shown in FIG. 1 at the ear of a user. The fibre and the sound tube have been coloured to make them more visible on the photograph for illustration purposes only. The fibre 22 is adapted for abutting the outer ear 26 at the lower part of the concha 28 behind the antitragus 30 at which position the fibre 22 is substantially invisible and provides secure retention of the earpiece 16 in the ear canal 32.

The resilience of the fibre allows the fibre to apply a force to the earpiece towards the ear canal to retain the earpiece in a position in which the earpiece is pressed against an anatomical feature within the ear canal.

The illustrated earpiece is provided in standard sizes and is comfortable to wear and aesthetical and the fibre 22 enables it to be securely and comfortably fastened in the ear canal of a user.

Figure 3:
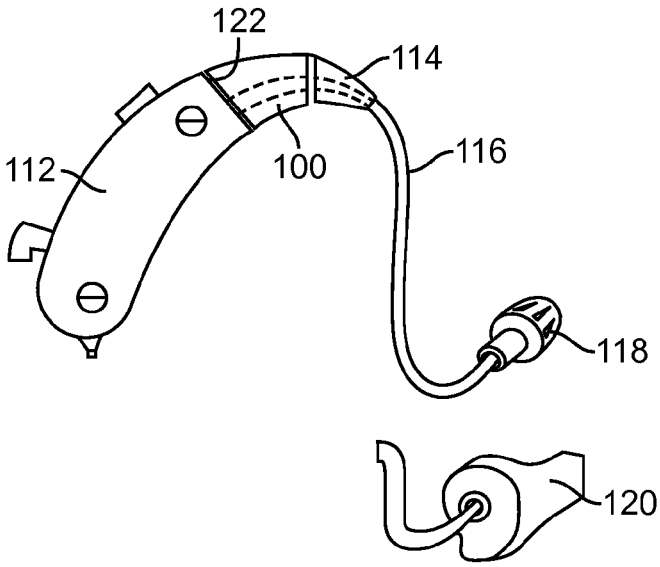
FIG. 3 shows a BTE hearing aid housing with an adaptor according to the present invention, FIG. 4 schematically illustrates positioning of a BTE hearing aid housing with an adaptor at the ear.

FIG. 3 illustrates an adaptor 100 according to the present invention connected to a BTE hearing aid housing 112 and a sound tube connector 114. The sound tube 116 may be connected to an earpiece 118 or a shell or an earmould 120 for insertion into the ear canal.

Figure 4:
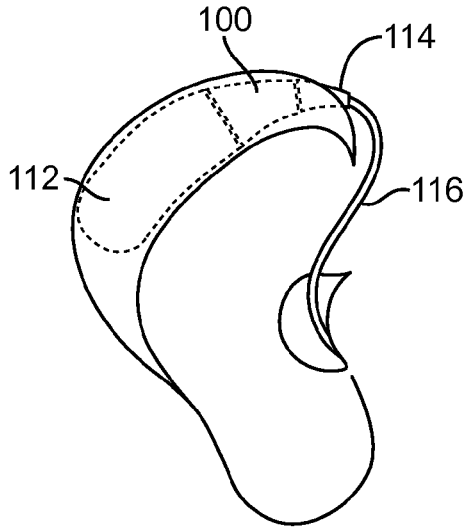

FIG. 4 illustrates the correct positioning of the hearing aid with the adaptor at the user's ear. It should be noted that the position 122 of the microphone is not changed due to use of the adaptor since the sound tube 116 is shorter than the sound tube used without an adaptor.

Figure 5:
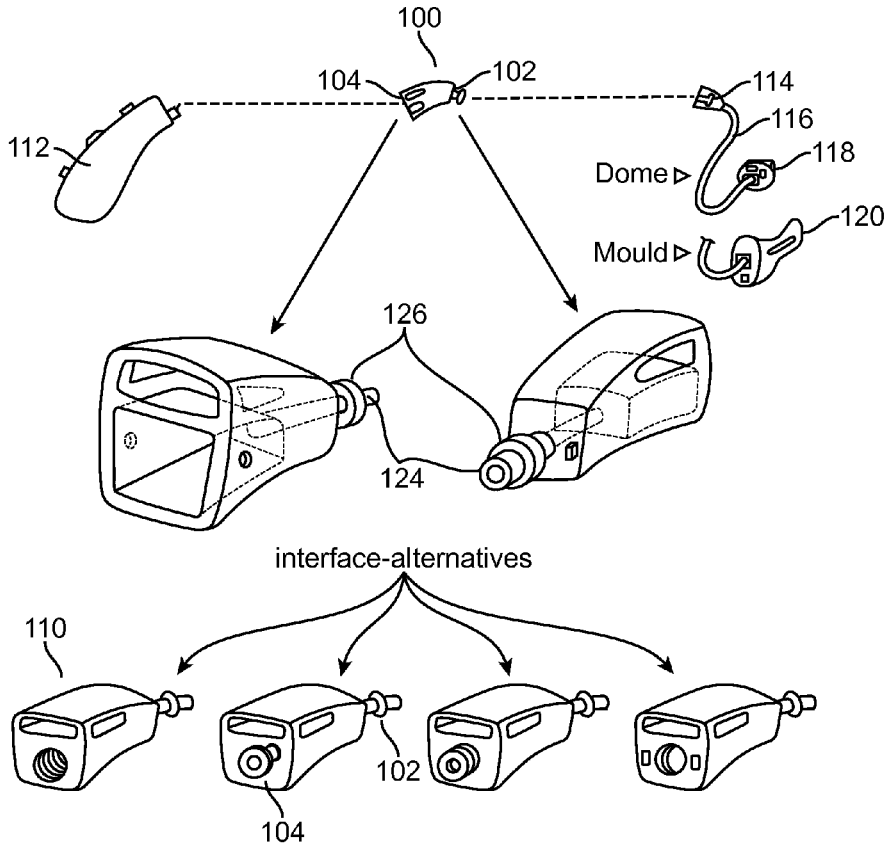
FIG. 5 is a perspective view of various embodiments of the invention, FIG. 6 schematically illustrates various embodiments of the invention, FIG. 7 schematically illustrates other various ways of attaching the adaptor to a BTE housing.

FIG. 5 is a perspective view of various embodiments of the adaptor constituting a set 110 of adaptors for fitting the sound tube coupling of BTE hearing aid housings 112 of different manufacturers. In the illustrated embodiment, the first end 102 of the adaptor 100 adapted for connection with a sound tube connector 114 comprises a generally cylindrical member 124 extending along a longitudinal axis with a bead 126 for snap coupling by insertion into the sound tube connector 114 for secure attachment by resilience of the member 124 and/or connector 114. The second end 104 of the adaptor 100 is geometrically adapted for connection with the hearing aid housing 112.

Figure 6:
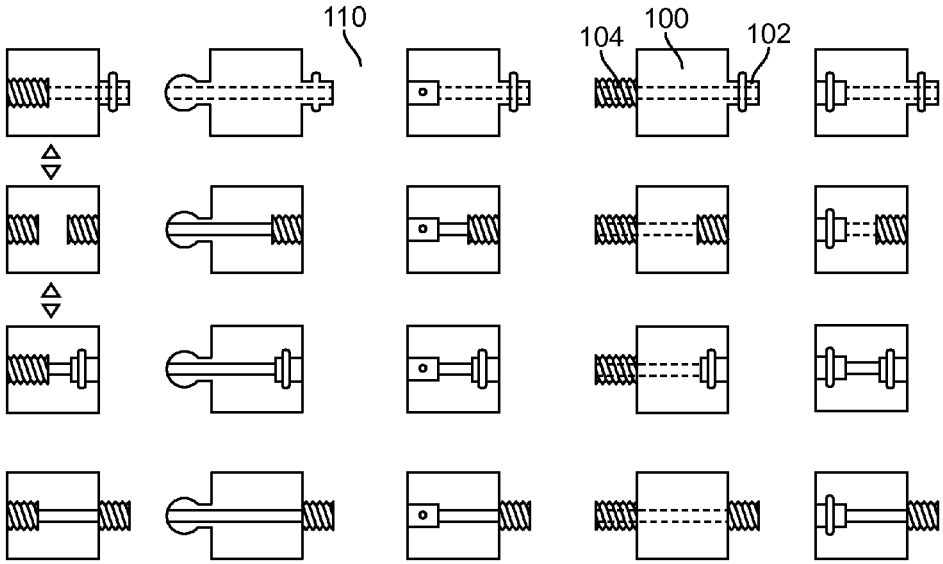

FIG. 6 schematically illustrates a larger set 110 of adaptors according to the present invention. The upper row shows the embodiments also shown in FIG. 5 while the other rows illustrate alternative coupling geometries between the sound tube connector and the first end 102 of the adaptor. The person skilled in the art will appreciate that other coupling principles and geometries may also be contemplated.

Figure 7:
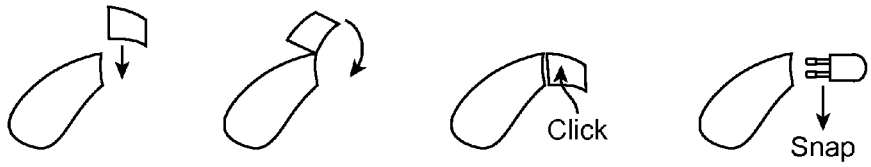
Figure 8:
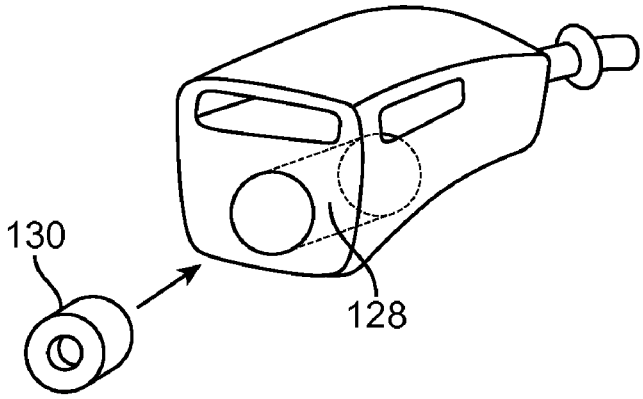
FIG. 8 is a perspective view of an adaptor according to the invention with a cerumen guard.

FIG. 7 schematically illustrates various other ways of attaching the adaptor to a BTE housing, FIG. 8 is a perspective view of an adaptor 100 according to the invention with a compartment 128 for accommodation of a cerumen guard 130 that is positioned in the transmission path of sound emitted by the receiver and protecting the BTE housing from entrance of cerumen. Alternatively, the compartment 128 may contain an acoustic filter for improved sound quality. In another embodiment, the cerumen guard is moulded as an integral part of the adaptor.

Figure 9:
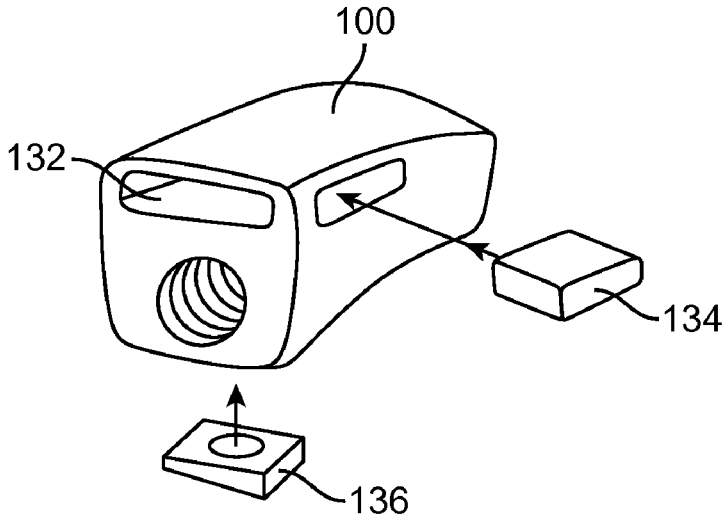
FIG. 9 is a perspective view of an adaptor according to the invention with a wind noise filter.

FIG. 9 is a perspective view of an adaptor 100 according to the invention with a compartment 132 for accommodation of a wind noise or moisture filter 134 for suppression of wind noise emitted by the receiver. Further the adaptor 100 may have a compartment (not shown) for accommodation of a left/right marking 136.

The invention claimed is:

1. An adaptor for
a BTE hearing aid with
a housing to be worn behind the ear,
an earpiece for insertion in the ear canal, and
a signal transmission member for transmission of a signal from the housing at a first end of the member to the earpiece at a second end of the member, the signal transmission member having a connector at the first end,
wherein the housing and the connector of the signal transmission member are not adapted for mutual mechanical interconnection, wherein
the adaptor has
a first end that is geometrically adapted for mechanical connection with the connector of the signal transmission member and
a second end that is geometrically adapted for mechanical connection with the housing,
wherein the adaptor is configured to alternatively connect with another signal transmission member, or to alternatively connect with another housing, thereby reducing a number of hearing aid components to be kept in stock by a hearing aid dispenser; and
wherein the signal transmission member is a sound tube for acoustical transmission of an acoustic sound signal through it.

2. The adaptor according to claim 1, further comprising a compartment communicating with the signal transmission member and accommodating an acoustical filter.

3. The adaptor according to claim 1, further comprising a compartment communicating with the signal transmission member and accommodating a cerumen guard.

4. The adaptor according to claim 1, further comprising a compartment accommodating a wind noise filter.

5. An adaptor for use with a hearing aid, comprising:
a first end that is configured for detachably connection with a connector of a first signal transmission member, the first signal transmission member configured for placement outside an ear canal; and
a second end that is configured for detachably coupling with a housing of the hearing aid;
wherein the first end is also configured for detachably connection with a connector of a second signal transmission member, the first and second signal transmission members being different from each other, and are capable of selectively coupling to the housing through the adaptor and
wherein the first signal transmission member comprises a sound tube that transmits sound acoustically, and wherein the adaptor comprises a lumen for acoustically coupling the sound tube to the housing.

6. The adaptor of claim 5, wherein the first signal transmission member and the second signal transmission member have different respective lengths.

7. The adaptor of claim 5, wherein the first signal transmission member and the second signal transmission member have different respective shapes.

8. The adaptor of claim 5, further comprising a compartment communicating with the first signal transmission member, wherein the compartment is configured for accommodating an acoustic filter.

9. The adaptor of claim 5, further comprising a compartment communicating with the first signal transmission member, wherein the compartment is configured for accommodating a cerumen guard.

10. The adaptor of claim 5, further comprising a compartment for accommodating a wind noise filter.

11. A hearing aid system, comprising:
a first adaptor having:
a first end that is configured for detachably connection with a connector of a first signal transmission member, the first signal transmission member configured for placement outside an ear canal, and
a second end that is configured for detachably coupling with a housing of a hearing aid; and
a second adaptor having:
a first end that is configured for detachably connection with a connector of a second signal transmission member, and
a second end that is configured for detachably coupling with the housing of the hearing aid;
wherein the connector of the first signal transmission member and the connector of the second signal transmission member have different respective configurations, and are capable of selectively coupling to the housing through the first and the second adaptors, respectively; and
wherein the first signal transmission member comprises a sound tube that transmits sound acoustically, and wherein the first adaptor comprises a lumen for acoustically coupling the sound tube to the housing.

12. The hearing aid system of claim 11, wherein the first end of the first adaptor is also configured for detachably connection with a connector of a third signal transmission member, the first and third signal transmission members being different from each other, and are capable of selectively coupling to the housing through the first adaptor.

13. The hearing aid system of claim 11, further comprising the hearing aid, the hearing aid having the housing configured to be worn behind an ear of a user, and an earpiece for insertion in the ear canal.

14. The hearing aid system of claim 13, further comprising at least one resilient fiber that is connected to the earpiece for abutting a lower part of a concha when the earpiece has been inserted in the ear canal thereby providing retention of the earpiece in the ear canal of the user.

15. The hearing aid system of claim 11, further comprising a compartment communicating with the first signal transmission member, wherein the compartment is configured for accommodating an acoustic filter.

16. The hearing aid system of claim 11, further comprising a compartment communicating with the first signal transmission member, wherein the compartment is configured for accommodating a cerumen guard.

17. The hearing aid system of claim 11, further comprising a compartment for accommodating a wind noise filter.

18. A hearing aid system, comprising:

a first adaptor having:

a first end that is configured for detachably connection with a connector of a first signal transmission member, the first signal transmission member configured for placement outside an ear canal, and a second end that is configured for detachably coupling with a housing of a first hearing aid; and a second adaptor having:

a first end that is configured for detachably connection with the connector of the first signal transmission member, and a second end that is configured for detachably coupling with a housing of a second hearing aid;

wherein the housings of the first and second hearing aids have different respective configurations, and are capable of selectively coupling to the connector of the first signal transmission member through the first and second adaptors, respectively; and wherein the first signal transmission member comprises a sound tube that transmits sound acoustically, and wherein the first adaptor comprises a lumen for acoustically coupling the sound tube to the housing of the first hearing aid.

19. The hearing aid system of claim 18, wherein the first end of the first adaptor is also configured for detachably connection with a connector of a second signal transmission member, the first and second signal transmission members being different from each other, and are capable of selectively coupling to the housing of the first hearing aid through the first adaptor.

20. The hearing aid system of claim 18, further comprising the first hearing aid, the first hearing aid having the housing configured to be worn behind an ear of a user, and an earpiece for insertion in the ear canal.

21. The hearing aid system of claim 20, further comprising at least one resilient fiber that is connected to the earpiece for abutting a lower part of a concha when the earpiece has been inserted in the ear canal thereby providing retention of the earpiece in the ear canal of the user.

22. The hearing aid system of claim 18, further comprising a compartment communicating with the first signal transmission member, wherein the compartment is configured for accommodating an acoustic filter.

23. The hearing aid system of claim 18, further comprising a compartment communicating with the first signal transmission member, wherein the compartment is configured for accommodating a cerumen guard.

24. The hearing aid system of claim 18, further comprising a compartment for accommodating a wind noise filter.

* * * * *